US005862234A

United States Patent [19]

Todter et al.

[11] Patent Number: 5,862,234

[45] Date of Patent: Jan. 19, 1999

[54] ACTIVE NOISE CANCELLATION SYSTEM

[76] Inventors: Chris Todter, 4222 Orchard Ave., San Diego, Calif. 92107; Scott Clifton, 53-55 Shephard Street, Marrickville NSW 2204, Australia; Paul Bremner, 5255 Mira Sorrento Pl. #100, San Diego, Calif. 92121

[21] Appl. No.: 446,589

[22] PCT Filed: Nov. 12, 1993

[86] PCT No.: PCT/US93/10958

§ 371 Date: Mar. 8, 1996

§ 102(e) Date: Mar. 8, 1996

[87] PCT Pub. No.: WO94/11953

PCT Pub. Date: May 26, 1994

[30] Foreign Application Priority Data

Nov. 11, 1992 [AU] Australia ..... PL5792

[51] Int. Cl.[6] ..... G10K 11/16

[52] U.S. Cl. ..... 381/71.6; 381/71.7; 381/71.8; 381/96

[58] Field of Search ..... 381/71, 83, 93, 381/94, 163, 71.6, 71.7

[56] References Cited

U.S. PATENT DOCUMENTS 4,243,839 1/1981 Takahashi et al. ..... 381/96

4,712,247 12/1987 Swarte ..... 381/96

4,833,719 5/1989 Carme et al. ..... 381/71.6

4,985,925 1/1991 Langberg et al. ..... 381/71

5,267,321 11/1993 Langberg ..... 381/71

*Primary Examiner*—Forester W. Isen

*Attorney, Agent, or Firm*—Thomas J. Tighe

[57] ABSTRACT

A bilateral transducer (18) for use in an active noise cancellation system both senses ambient noise and produces acoustic waves to cancel the noise. The electrical interface for each bilateral transducer circuit consists of a speaker drive signal as an input and a simulated microphone signal as an output. In a first embodiment, the drive signal to the bilateral transducer is periodically turned off at a rate above audibility, and in the "off period" the transducer's drive element is sensed to produce a reverse output signal from which is subtracted a synthesized signal representing the speaker velocity response to the drive signal to produce the simulated microphone signal. In further embodiments, the reverse output signal is derived by sensing the energy being sent to the transducer to produce the acoustic waves, or by a separate sensing coil in a coil driven transducer.

12 Claims, 2 Drawing Sheets

ACTIVE NOISE CANCELLATION SYSTEM

BACKGROUND OF THE INVENTION

This invention relates in general to active noise cancellation systems, and in particular to such systems which employ a microphone proximate a listener's ear to receive essentially the same ambient noise received by the ear and a speaker for producing sound in the vicinity of the microphone to cancel the ambient noise.

Prior art as in U.S. Pat. No. 2,972,018 by Hawley et al. (1953) provide for a microphone which responds to ambient noise and a speaker which transmits an altered version of the ambient noise to provide a measure of noise cancellation in the region of the microphone. Virtually all subsequent patents of improvement incorporate some variant of this concept, but they all use microphones.

This invention takes advantage of the known fact that certain kinds of speakers (e.g. diaphragm speakers) respond to pressure waves of incoming sound (e.g. ambient noise) and produce an output signal representative of the incoming sound.

Other advantages and attributes of this invention will be readily discernable from a reading of the text hereinafter.

SUMMARY OF THE INVENTION

An object of this invention is to provide the means to implement active noise attenuation systems without the need to use a microphone.

A further object of this invention is to provide an active noise attenuation system in a which a speaker is used as a bilateral transducer, i.e. a transducer that both converts acoustic waves to corresponding electrical energy and converts electrical energy to acoustic waves.

These and other objects, which are apparent from this specification, are achieved by an improvement for at least eliminating the microphone from any ANC ("active noise control") device having at least a microphone which responds to ambient acoustic noise waves and a speaker which transmits an altered version of the ambient noise waves over a frequency range to provide a measure of noise cancellation in the region of the microphone, the improvement comprising: (a) bilateral transducer means, disposed in said region, for converting the acoustic noise waves to a corresponding first signal and for converting a second signal to corresponding acoustic waves; and (b) means for applying a transfer function to the first signal, over said frequency range, resulting in the second signal, the transfer function causing acoustic waves produced by the bilateral transducer to be generally equal in magnitude but opposite in phase to the acoustic noise waves impinging the bilateral transducer. The objects are also achieved by two embodiments of an ANC system. A first embodiment comprises: (a) a bilateral transducer means, disposed proximate a listener so as to be impinged by the same acoustic noise waves to which the listener is subjected, for converting the acoustic noise waves to a corresponding first signal and for converting a second signal to corresponding acoustic waves; and (b) means for applying a transfer function to the first signal, over a frequency range, resulting in the second signal, the transfer function causing acoustic waves produced by the bilateral transducer to be generally equal in magnitude but opposite in phase to the acoustic noise waves impinging the bilateral transducer. A second embodiment comprising: (a) bilateral transducer means, disposed proximate a listener so as to be impinged by the same acoustic noise waves to which the listener is subjected, for converting the acoustic noise waves to a corresponding first signal and for converting a sum signal to corresponding acoustic waves; (b) means for applying a transfer function to the first signal, over a frequency range, resulting in a second signal; (c) a feed forward circuit comprising: (i) acousto-electric transducer means, disposed to be impinged by the same acoustic noise waves to which the listener is subjected for converting the noise waves to a corresponding third signal, and (ii) means for applying a transfer function to the third signal resulting in a fourth signal; and (d) means for summing the second and the fourth signals to produce the sum signal, the overall transfer function being ideally negative unity over the frequency range.

There are multiple ways of embodying the bilateral transducer means and thus eliminating the need for additional microphones. In a first embodiment the drive to a speaker is periodically turned off at a rate above the hearing frequency limit, and in the "off period" the speaker drive element is sensed by a circuit that produces a signal which is the combination of a signal representing the speaker velocity caused by a speaker drive signal and a signal caused by ambient noise because of the speaker's inherent ability to act as a microphone. The latter signal is separated from the composite to produce a simulated microphone representation of ambient noise which is then processed in further active noise circuitry in a known ways. In further embodiments use is made of a non-zero output impedance of the drive amplifier, across which appears a combination of signals. These signals represent both some measure of the speaker representation of its intended drive signal and the ambient noise impinging the speaker. These signals are separated and the noise component is treated in the normal active noise control manner.

DESCRIPTION OF THE PREFERRED EMBODIMENT

Figure 1:
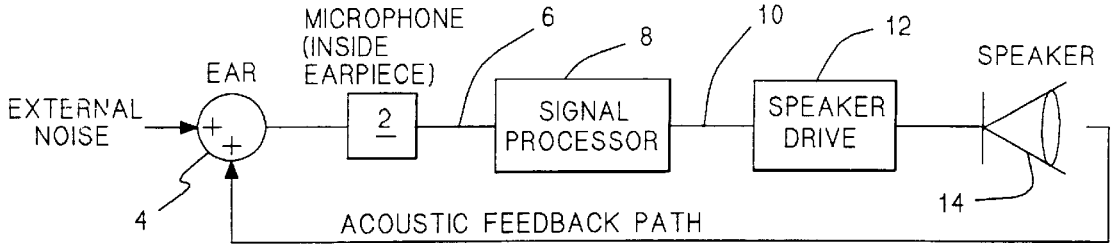
FIG. 1 Prior Art
FIG. 1 is a functional block diagram of a prior art active noise cancellation system.

Referring to FIG. 1, a basic prior art ANC system is illustrated to have a first transducer 2 in the form of a microphone proximate a listener's ear 4, e.g. inside of an earpiece covering the listener's ear. The microphone is located to receive essentially the same acoustic noise that the ear is receiving and convert this noise into corresponding electrical energy, i.e. electrical signals at the microphone's output 6. These electrical signals are processed by a signal processor 8 to produce speaker drive input signals 10 which are communicated to a speaker driver 12 which in turn sends corresponding electrical drive energy to a second transducer in the form of a speaker 14. The speaker converts the electrical drive energy into corresponding acoustic waves which are directed to impinge the listener's ear. Ideally, the gain in the feedback loop is negative unity such that the acoustic waves impinging the ear from the speaker are at all times equal in magnitude but opposite in phase to that of the ambient noise impinging the ear. The noise and the acoustic waves produced by the speaker are ideally summed to zero at the listener's ear.

Figure 2:
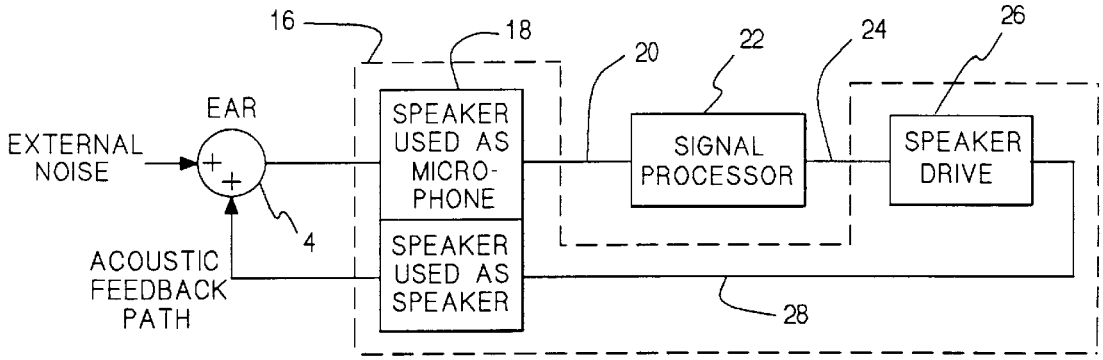
FIG. 2 is a functional block diagram of a first embodiment of an active noise cancellation system according to this invention.

Referring to FIG. 2, a first embodiment of this invention is illustrated as having the microphone and speaker of FIG. 1 replaced by a circuit 16 ("bilateral transducer circuit") having a bilateral transducer. As used herein "bilateral transducer" shall refer to and mean a transducer which produces acoustic waves by means of a vibratory element in response to, and corresponding to, an energization signal applied to the transducer, and which produces a reverse output in response to, and corresponding to, mechanical movement of the vibratory element not attributable to energization. As illustrated, the bilateral transducer is a speaker 18 disposed in the system to function both as a microphone and a speaker. The bilateral transducer circuit produces a "microphone" output signal 20, a simulated microphone signal, corresponding to ambient noise. The simulated microphone output signal is communicated to a signal processor 22 to produce a corresponding speaker drive input signal 24 which is communicated to a speaker driver 26. The speaker driver produces a corresponding speaker drive signal 28 which causes the bilateral transducer 18 to produce corresponding acoustic waves intended to cancel the ambient noise. As in the conventional ANC of FIG. 1, the loop gain is preferably negative unity.

Figure 3:
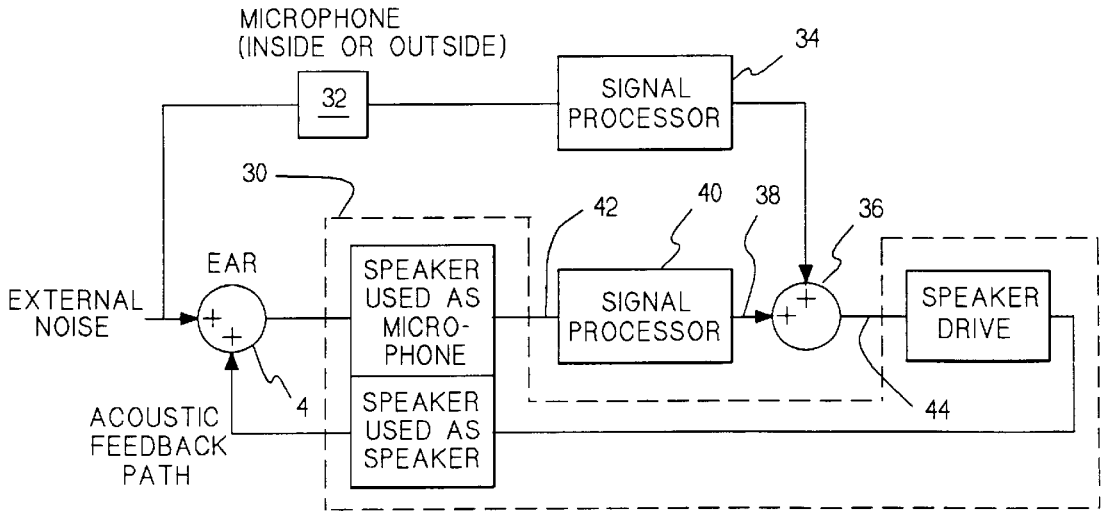
FIG. 3 is a functional block diagram of a second embodiment of an active noise cancellation system according to this invention.

Referring to FIG. 3, a second embodiment of this invention is similar to the first embodiment illustrated in FIG. 2 in that there exists an acoustic feedback loop utilizing a bilateral transducer circuit 30, but in addition there is a feed forward circuit having a microphone 32 which can be disposed inside or outside of an earpiece (not shown) the output of which is communicated to a first signal processor 34 the output of which is communicated as an input to a signal adder 36. Another input to the adder is the output 38 of a second signal processor 40 which receives as an input a simulated microphone output 42 from the bilateral circuit 30. The sum output of the adder is communicated to the bilateral circuit 30 as a speaker input drive signal 44. Such a feed forward circuit is described in PCT patent application No. PCT/US91/06636 by the same inventors as listed herein.

Figure 4:
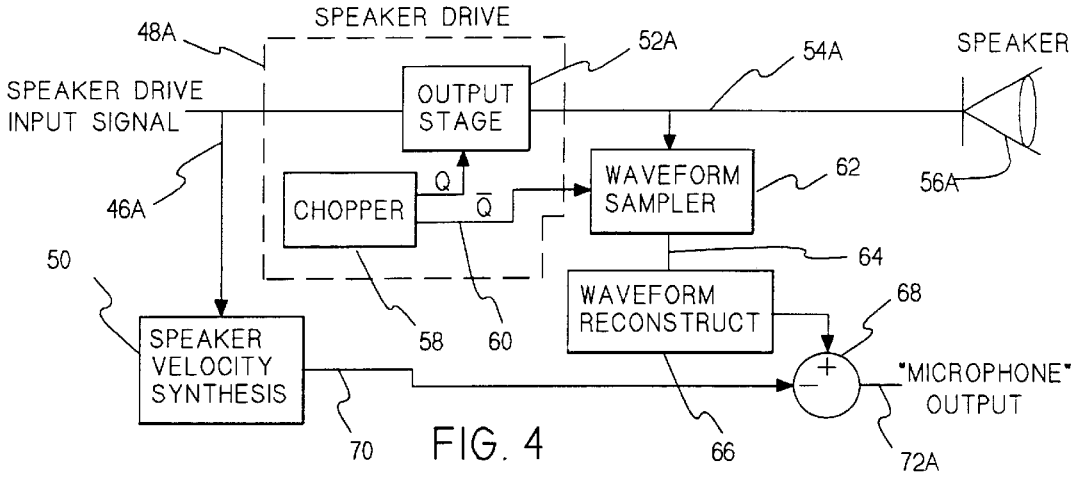
FIG. 4 is a functional block diagram of a first embodiment of a bilateral transducer circuit according to this invention.

Referring to FIG. 4, a first embodiment of a bilateral transducer circuit is illustrated to have a speaker drive input signal 46A from an ANC system (e.g. see 24 and 44 of FIGS. 2 and 3) communicated to both a speaker drive circuit 48A and a speaker velocity synthesis circuit 50. The speaker drive circuit contains an output stage 52A which produces a speaker drive signal 54A corresponding to the speaker drive input signal. The speaker drive signal is communicated to a speaker 56A in order to cause it to produce acoustic waves intended to cancel ambient noise, but the speaker drive signal is gated "on" and "off" by a "Q" output of an oscillating chopper circuit 58. By "on" it is meant that when Q is logically true, the output of the output stage is enabled so that speaker drive signal is communicated to the input of the speaker; but when Q is logically false, the output of the output stage is disabled and presents only a high impedance to the speaker input. The chopper also provides a sampling clock 60 to a waveform sampling circuit 62 having an input communicating with the input of the speaker. The sampling clock can be, or be derived from, for example the logical compliment of Q. The output 64 of the waveform sampling circuit is communicated to a waveform reconstruction circuit 66, the output of which is communicated to a signal subtractor 68 which subtracts therefrom the output 70 of the speaker velocity synthesis circuit 50 to produce a simulated microphone output 72A for use in an ANC system (e.g. see 20 and 42 of FIGS. 2 and 3).

The bilateral transducers can be diaphragm speakers with coil drives of conventional design because it is well known that they generate electrical energy corresponding and in response to mechanical movement of the diaphragms by external forces, such as ambient acoustic waves. Alternately, the bilateral transducers can be piezofilm transducers which basically are each a diaphragm coated with capacitive electrodes that can be made to bend or vibrate by input of electrical signals. A piezofilm transducer is inherently bilateral in that if the diaphragm is bent or stretched as in vibration, it generates an output voltage. The latter has significant advantage because by applying the electrodes strategically to benefit on the surface of the diaphragm, it is possible to alter or affect or correct some of the undesirable resonance modes of a standard diaphragm, thus improving the performance of the system of this invention. The generated electrical energy is felt across the input terminals of the speakers' drive elements, e.g. the terminals of drive coils and piezofilm coatings.

Referring again to FIG. 4, the chopper circuit 58 preferably oscillates at a high frequency relative to audible sound, for example 100 kilohertz, which is sufficiently above the audible sound range to negligibly effect the noise cancellation. During the times that the speaker drive signal is gated off, the electrical energy generated by the speaker (which can be called the speaker's "reverse output") corresponds to the speaker's diaphragm velocity which is the algebraic sum of a velocity component caused by the speaker drive signal just gated off plus any velocity component due to impinging acoustic noise waves. The waveform sampling circuit 62 samples the speaker's reverse output in response to each sampling clock and communicates the samples in real time to the waveform reconstruction circuit 66 which can be a low pass filter. By this technique, the output of the reconstruction circuit is a signal which corresponds in real time to the algebraic sum of the two diaphragm velocity components. The reverse output signal also corresponds to the algebraic sum of the acoustic waves being created by the diaphragm due to the drive signal 54A and the acoustic noise waves impinging the diaphragm. The speaker velocity synthesis circuit 50 produces a frequency dependent signal 70 corresponding to what the speaker's velocity response would be to the speaker drive input signal 46A without any external noise components, and therefore also corresponding to the acoustic waves being created by the diaphragm. By subtracting the synthesized signal from the reverse output signal, the simulated microphone output 72A is ideally a signal which corresponds only to the acoustic noise impinging the speaker's diaphragm.

Figure 5:
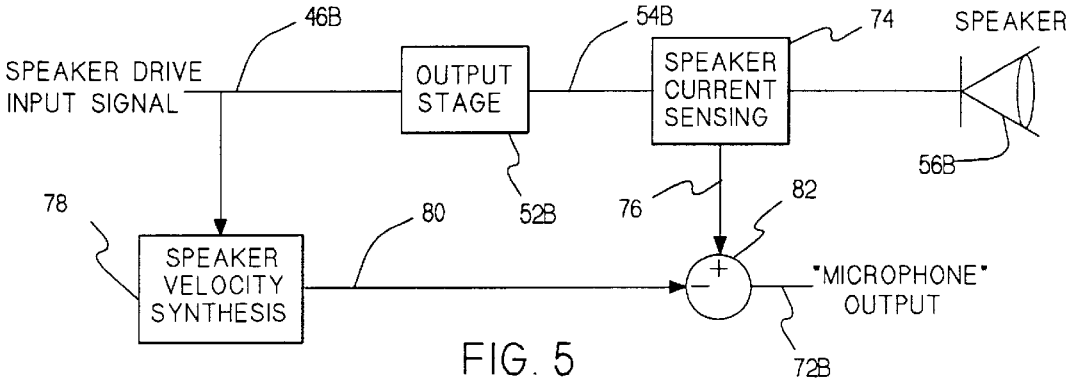
FIG. 5 is a functional block diagram of a second embodiment of a bilateral transducer circuit according to this invention.

Referring to FIG. 5, a second embodiment of a bilateral transducer circuit is illustrated to have a speaker output stage 52B which receives as an input a speaker drive input signal 46B from an ANC system (e.g. see 24 and 44 of FIGS. 2 and 3). The output stage produces a speaker drive signal 54B corresponding to the speaker drive input signal. The speaker drive signal is communicated to a speaker 56B in order to cause it to produce acoustic waves intended to cancel ambient noise.

A sensing circuit 74 continuously senses the level of current in the signal path between the output stage and the speaker and produces a signal 76 ("current level signal") corresponding thereto. The sensing circuit can, for example, be a linear circuit having a differential input of relatively high impedance (so as not to unduly load the signal path) connected across the output impedance of the output stage. The current in the signal path at any given time is the algebraic sum of the current of the speaker drive signal 54B and the speaker's reverse output current, and therefore the current level signal corresponds in real time to the algebraic sum of the diaphragm velocity component caused by the speaker drive signal 54B and the velocity component due to impinging acoustic noise waves. As in FIG. 4, the speaker's velocity response to the speaker drive input signal 46B is synthesized in real time by a circuit 78 which produces a synthesized velocity signal 80 which is subtracted from the current level signal by a subtractor 82 to produce the simulated microphone output 72B for use in an ANC system (e.g. see 20 and 42 of FIGS. 2 and 3). By subtracting the synthesized signal from the current level signal, the simulated microphone output 72A is ideally a signal which corresponds only to the acoustic noise impinging the speaker's diaphragm.

Figure 6:
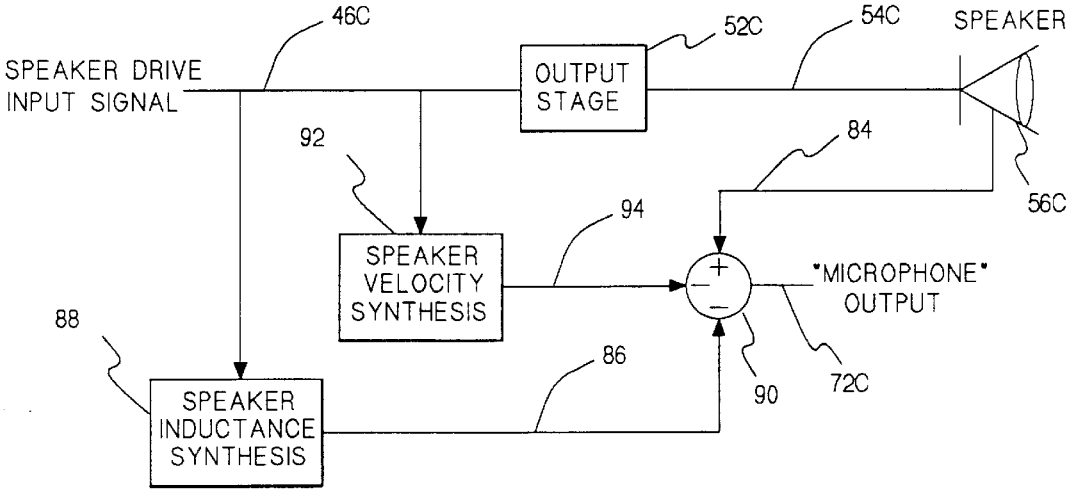
FIG. 6 is a functional block diagram of a third embodiment of a bilateral transducer circuit according to this invention.

Referring to FIG. 6, a third embodiment of a bilateral transducer circuit is illustrated to have a speaker output stage 52C which receives as an input a speaker drive input signal 46C from an ANC system (e.g. see 24 and 44 of FIGS. 2 and 3). The output stage produces a speaker drive signal 54C corresponding to the speaker drive input signal. The speaker drive signal is communicated to a speaker 56C in order to cause it to produce acoustic waves intended to cancel ambient noise.

The speaker has a drive coil of conventional design but also has a sensing coil wound along therewith (not shown) for providing a speaker reverse output signal 84 ("sensing coil signal") that is dependent on the speaker diaphragm velocity and inductive coupling between the speaker drive coil (not shown) and the sensing coil. To remove the effects of the inductive coupling from the sensing coil signal, a signal 86 produced by a speaker inductance synthesizing circuit 88 is subtracted from the sensing coil signal by means of subtractor 90. The speaker inductance synthesizer is responsive to the speaker drive input signal 46C and the signal produced thereby simulates the signal induced in the sensing coil by the speaker drive coil. As in FIGS. 4 and 5, the speaker's velocity response is synthesized by a circuit 92 that produces a synthesized signal 94 that is also subtracted from the sensing coil signal by subtractor 90 to finally arrive at a simulated microphone signal 72C which ideally corresponds only to the acoustic noise impinging the speaker's diaphragm.

Each of the speaker velocity synthesizers described above can be an implementation of a transfer function based on a known model of the speaker. The speakers of this invention can be modeled by known techniques. For example, a speaker can be characterized by applying known drive signals, within a selected frequency band, to the speaker's drive element while measuring the diaphragm's velocity. Preferably the known drive signals are random signals simulating noise over the frequency band in order to more accurately model the speaker for noise cancellation. From this the transfer function of the speaker can be determined and a synthesizer (e.g. a network of gain and phase shifting elements) can be designed therefrom using conventional design techniques. Likewise the speaker inductance synthesizer 88 of FIG. 6 can be designed and implemented in similar fashion. For example, the inductive coupling can be characterized by applying known drive signals, e.g. simulated random signals, within a selected frequency band, to the speaker's drive element while measuring the sensing coil signals. Alternatively, the synthesizers can each be implemented in a long term adaptive circuit varied in near real time.

While two embodiments of ANC systems having bilateral transducer circuits were described, the use of the bilateral transducer circuits is not limited to these ANC embodiments, but rather a bilateral transducer circuit according to this invention can be used to improve any device having at least a microphone which responds to ambient acoustic noise waves and a speaker which transmits an altered version of the noise waves over a frequency range to provide a measure of noise cancellation in the region of the microphone. One improvement is the elimination of the microphone. Other improvements and advantages are that the use of a speaker in a bilateral sense, that is as both a speaker and a microphone, first of all puts the sensing surface co-planar with the speaker, and secondly tends to inverse frequency characteristics of the speaker which helps to compensate for speaker resonances and other undesirable characteristics.

The foregoing description and drawings were given for illustrative purposes only, it being understood that the invention is not limited to the embodiments disclosed, but is intended to embrace any and all alternatives, equivalents, modifications and rearrangements of elements falling within the scope of the invention as defined by the following claims.

We claim:

1. For a device having at least a microphone which responds to ambient acoustic noise waves and a speaker which transmits an altered version of the ambient noise waves over a frequency range to provide a measure of noise cancellation in the region of the microphone, an improvement for at least eliminating the microphone comprising:

(a) bilateral transducer means, disposed in said region, for converting the acoustic noise waves to a corresponding first signal and for converting a second signal to corresponding acoustic waves, and (b) means for applying a transfer function to the first signal, over said frequency range, resulting in the second signal, the transfer function causing acoustic waves produced by the bilateral transducer to be generally equal in magnitude but opposite in phase to the acoustic noise waves impinging the bilateral transducer.

2. The improvement according to claim 1 wherein the bilateral transducer means comprises:

(a) bilateral transducer having a common port for energization and reverse output, (b) means for energizing the bilateral transducer in response to and corresponding to said second signal, (c) means for periodically de-energizing the bilateral transducer at a rate high above a normal audible frequency limit, (d) means for sampling the common port during times when the bilateral transducer is de-energized, (e) means for receiving the samples and constructing therefrom a reverse output signal, (f) means for receiving said second signal and synthesizing therefrom a signal representative of what the bilateral transducer's velocity response would be to said second signal in the absence of said ambient acoustic noise waves, and (g) means for subtracting the synthesized signal from the reverse output signal, the difference being said first signal.

3. The improvement according to claim 1 wherein the bilateral transducer means comprises:

(a) a bilateral transducer having a common port for energization and reverse output, (b) drive means for providing energy to said port via a signal path in response to and corresponding to said second signal, (c) sensing means for continuously measuring the energy level in said signal path and producing a signal corresponding thereto, (d) means for receiving said second signal and synthesizing therefrom a signal representative of what the bilateral transducer's velocity response would be to said second signal in the absence of said ambient acoustic noise waves, and (e) means for subtracting the synthesized signal from the signal produced by the sensing means, the difference being said first signal.

4. The improvement according to claim 1 wherein the bilateral transducer means comprises:

(a) a bilateral transducer having a drive coil and a sensing coil for producing a reverse out put signal, (b) means for energizing the drive coil in response to and corresponding to said second signal, (c) means for receiving said second signal and synthesizing therefrom a signal representative of a signal induced in the sensing coil by the drive coil, (d) means for receiving said second signal and synthesizing therefrom a signal representative of what the bilateral transducer's velocity response would be to said second signal in the absence of said ambient acoustic noise waves, and (e) means for subtracting both synthesized signals from the reverse output signal, the difference being said first signal.

5. A device for canceling acoustic noise in the vicinity of a listener comprising:

(a) a bilateral transducer means, disposed proximate the listener so as to be impinged by the same acoustic noise waves to which the listener is subjected, for converting the acoustic noise waves to a corresponding first signal and for converting a second signal to corresponding acoustic waves, and (b) means for applying a transfer function to the first signal, over a frequency range, resulting in the second signal, the transfer function causing acoustic waves produced by the bilateral transducer to be generally equal in magnitude but opposite in phase to the acoustic noise waves impinging the bilateral transducer.

6. The device according to claim 5 wherein the bilateral transducer means comprises:

(a) a bilateral transducer having a common port for energization and reverse output, (b) means for energizing the bilateral transducer in response to and corresponding to said second signal, (c) means for periodically de-energizing the bilateral transducer at a rate high above a normal audible frequency limit, (d) means for sampling the common port during times when the bilateral transducer is de-energized, (e) means for receiving the samples and constructing therefrom a reverse output signal, (f) means for receiving said second signal and synthesizing therefrom a signal representative of what the bilateral transducer's velocity response would be to said second signal in the absence of said ambient acoustic noise waves, and (g) means for subtracting the synthesized signal from the reverse output signal, the difference being said first signal.

7. The device according to claim 5 wherein the bilateral transducer means comprises:

(a) a bilateral transducer having a common port for energization and reverse output, (b) drive means for providing energy to said port via a signal path in response to and corresponding to said second signal, (c) sensing means for continuously measuring the energy level in said signal path and producing a signal corresponding thereto, (d) means for receiving said second signal and synthesizing therefrom a signal representative of what the bilateral transducer's velocity response would be to said second signal in the absence of said ambient acoustic noise waves, and (e) means for subtracting the synthesized signal from the signal produced by the sensing means, the difference being said first signal.

8. The device according to claim 5 wherein the bilateral transducer means comprises:

(a) a bilateral transducer having a drive coil and a sensing coil for producing a reverse output signal, (b) means for energizing the drive coil in response to and corresponding to said second signal, (c) means for receiving said second signal and synthesizing therefrom a signal representative of a signal induced in the sensing coil by the drive coil, (d) means for receiving said second signal and synthesizing therefrom a signal representative of what the bilateral transducer's velocity response would be to said second signal in the absence of said ambient acoustic noise waves, and (e) means for subtracting both synthesized signals from the reverse output signal, the difference being said first signal.

9. A device for canceling acoustic noise in the vicinity of a listener comprising:

(a) bilateral transducer means, disposed proximate the listener so as to be impinged by the same acoustic noise waves to which the listener is subjected, for converting the acoustic noise waves to a corresponding first signal and for converting a sum signal to corresponding acoustic waves, (b) means for applying a transfer function to the first signal, over a frequency range, resulting in a second signal, (c) a feed forward circuit comprising:

(i) acousto-electric transducer means, disposed to be impinged by the same acoustic noise waves to which the listener is subjected for converting the noise waves to a corresponding third signal, (ii) means for applying a transfer function to the third signal resulting in a fourth signal, and (d) means for summing the second and the fourth signals to produce the sum signal, the overall transfer function being ideally negative unity over the frequency range.

10. The device according to claim 9 wherein the bilateral transducer means comprises:

(a) a bilateral transducer having a common port for energization and reverse output, (b) means for energizing the bilateral transducer in response to and corresponding to said second signal, (c) means for periodically de-energizing the bilateral transducer at a rate high above a normal audible frequency limit, (d) means for sampling the common port during times when the bilateral transducer is de-energized, (e) means for receiving the samples and constructing therefrom a reverse output signal, (f) means for receiving said second signal and synthesizing therefrom a signal representative of what the bilateral transducer's velocity response would be to said second signal in the absence of said ambient acoustic, noise waves, and (g) means for subtracting the synthesized signal from the reverse output signal, the difference being said first signal.

11. The device according to claim 9 wherein the bilateral transducer means comprises:

(a) a bilateral transducer having a common port for energization and reverse output, (b) drive means for providing energy to said port via a signal path in response to and corresponding to said second signal, (c) sensing means for continuously measuring the energy level in said signal path and producing a signal corresponding thereto, (d) means for receiving said second signal and synthesizing therefrom a signal representative of what the bilateral transducer's velocity response would be to said second signal in the absence of said ambient acoustic noise waves, and (e) means for subtracting the synthesized signal from the signal produced by the sensing means, the difference being said first signal.

12. The device according to claim 9 wherein the bilateral transducer means comprises:

(a) a bilateral transducer having a drive coil and a sensing coil for producing a reverse output signal, (b) means for energizing the drive coil in response to and corresponding to said second signal, (c) means for receiving said second signal and synthesizing therefrom a signal representative of a signal induced in the sensing coil by the drive coil, (d) means for receiving said second signal and synthesizing therefrom a signal representative of what the bilateral transducer's velocity response would be to said second signal in the absence of said ambient acoustic noise waves, and (e) means for subtracting both synthesized signals from the reverse output signal, the difference being said first signal.

* * * * *